US009389557B1

(12) United States Patent
Himeno

(10) Patent No.: US 9,389,557 B1
(45) Date of Patent: Jul. 12, 2016

(54) FIXING DEVICE

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Satoshi Himeno, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/791,669

(22) Filed: Jul. 6, 2015

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
See application file for complete search history.

(56) References Cited

U.S. PATENT DOCUMENTS 7,427,729 B2 * 9/2008 Asakura ..... G03G 15/2017 100/300
2003/0086736 A1 * 5/2003 Sekiguchi ..... G03G 15/2053 399/328
2007/0014601 A1 * 1/2007 Yasuda ..... H05B 6/145 399/329
2007/0019063 A1 * 1/2007 Yasuda ..... G03G 15/2042 347/223
2007/0201916 A1 * 8/2007 Ueno ..... G03G 15/2042 399/334
2009/0142114 A1 * 6/2009 Yasuda ..... G03G 15/2053 399/333
2009/0232565 A1 * 9/2009 Yasuda ..... G03G 15/2057 399/328
2009/0317157 A1 * 12/2009 Murakami ..... G03G 15/2057 399/333
2009/0317158 A1 * 12/2009 Murakami ..... G03G 15/2057 399/333
2014/0314457 A1 * 10/2014 Kikuchi ..... G03G 15/2053 399/329

* cited by examiner

*Primary Examiner* — G. M. Hyder
(74) *Attorney, Agent, or Firm* — Amin, Turocy & Watson LLP

(57) ABSTRACT

A fixing device of an exemplary embodiment includes a fixing belt, an induced current generation section, a first auxiliary heat generation section, and a second auxiliary heat generation section. The fixing belt includes a conductive layer. The induced current generation section opposes the fixing belt in a thickness direction. The induced current generation section performs electromagnetic induction heating on the conductive layer. The first auxiliary heat generation section opposes the induced current generation section with the fixing belt interposed therebetween. The first auxiliary heat generation section opposes a sheet passing region of the fixing belt in a width direction and contains ferrite. The second auxiliary heat generation section opposes the induced current generation section with the fixing belt interposed therebetween. The second auxiliary heat generation section opposes a sheet non-passing region of the fixing belt in the width direction and contains a magnetic material.

14 Claims, 6 Drawing Sheets

FIXING DEVICE

FIELD

Embodiments described herein relate generally to a fixing device.

BACKGROUND

In recent years, there are image forming apparatuses such as a multi-function peripheral (hereinafter, referred to as an "MFP") and a printer. The image forming apparatus includes a fixing device. The fixing device heats a conductive layer of a fixing belt by using an electromagnetic induction heating method (hereinafter, referred to as an "IH" method). The fixing device fixes a toner image to a recording medium with heat of the fixing belt. An auxiliary heat generation section concentrates magnetic flux during electromagnetic induction heating so as to increase an amount of generated heat in the fixing belt. The auxiliary heat generation section is formed of a magnetic shunt alloy. Magnetic characteristics of the magnetic shunt alloy change depending on a temperature. The magnetic shunt alloy transitions from a ferromagnet to a paramagnet with the Curie point as a boundary. The magnetic shunt alloy generates heat by itself. If the magnetic shunt alloy generates heat by itself, an internal temperature of the fixing belt increases. If the internal temperature of the fixing belt increases, a thermostat of the fixing belt may cause operation errors.

DETAILED DESCRIPTION

Figure 1:
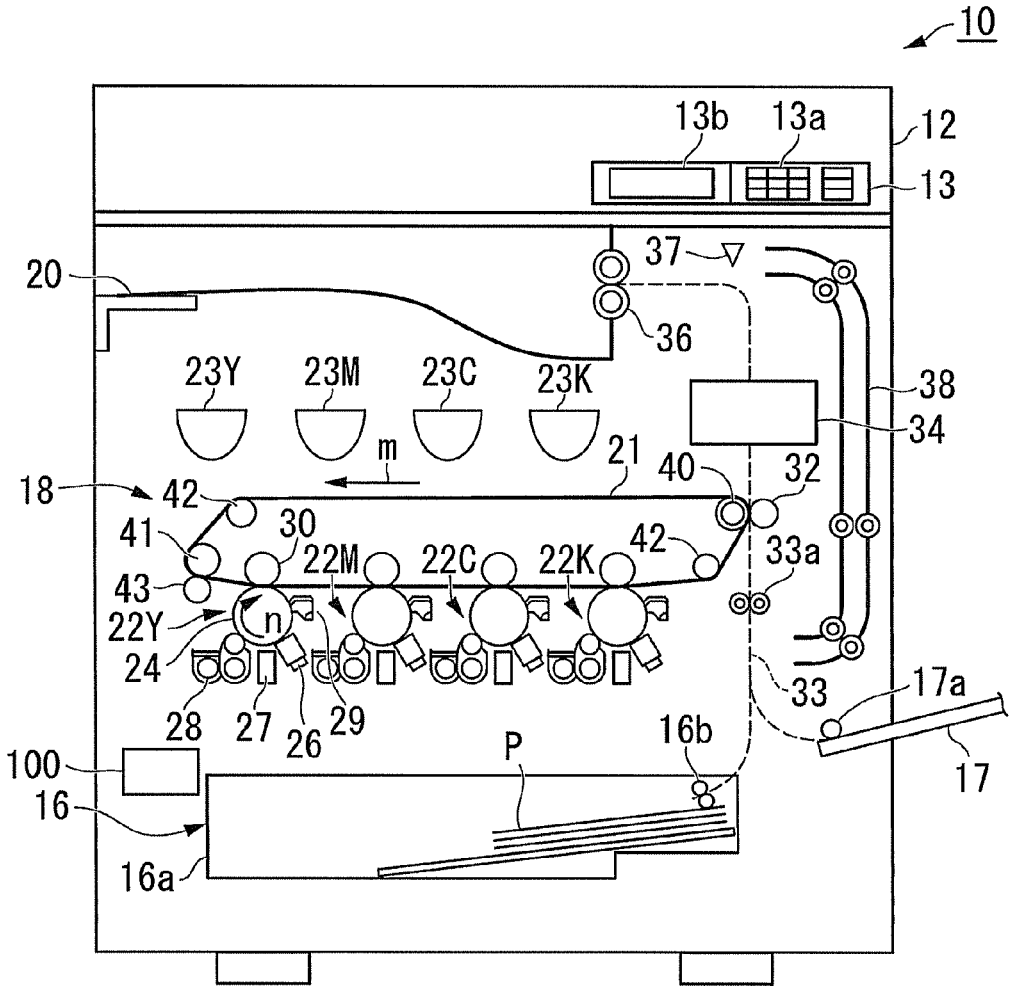
FIG. 1 is a side view of an image forming apparatus according to a first exemplary embodiment.

A fixing device of an exemplary embodiment includes a fixing belt, an induced current generation section, a first auxiliary heat generation section, and a second auxiliary heat generation section. The fixing belt includes a conductive layer. The induced current generation section opposes the fixing belt in a thickness direction. The induced current generation section performs electromagnetic induction heating on the conductive layer. The first auxiliary heat generation section opposes the induced current generation section with the fixing belt interposed therebetween. The first auxiliary heat generation section opposes a sheet passing region of the fixing belt in a width direction. The first auxiliary heat generation section contains ferrite. The second auxiliary heat generation section opposes the induced current generation section with the fixing belt interposed therebetween. The second auxiliary heat generation section opposes a sheet non-passing region of the fixing belt in the width direction. The second auxiliary heat generation section contains a magnetic material.

Hereinafter, an image forming apparatus 10 of a first exemplary embodiment will be described with reference to the drawings. In the respective drawings, the same constituent elements are given the same reference numeral.

FIG. 1 is a side view of the image forming apparatus 10 according to the first exemplary embodiment. Hereinafter, an MFP 10 will be described as an example of the image forming apparatus 10.

As illustrated in FIG. 1, the MFP 10 includes a scanner 12, a control panel 13, a paper feeding cassette unit 16, a paper feeding tray 17, a printer unit 18, and a paper discharge unit 20. The MFP 10 includes a CPU 100 which controls the entire MFP 10. The CPU 100 controls a main body control circuit 101 (refer to FIG. 2).

The scanner 12 reads an original document image. The control panel 13 includes an input key 13*a* and a display portion 13*b*. For example, the input key 13*a* receives an input operation from a user. For example, the display portion 13*b* is of a touch panel type. The display portion 13*b* receives an input operation from the user and performs corresponding display to the user.

The paper feeding cassette unit 16 includes a paper feeding cassette 16*a* and pickup rollers 16*b*. The paper feeding cassette 16*a* stores a sheet P which is a recording medium. The pickup rollers 16*b* extract the sheet P from the paper feeding cassette 16*a*.

The paper feeding cassette 16*a* feeds an unused sheet P. The paper feeding tray 17 feeds an unused sheet P with a pickup roller 17*a*.

The printer unit 18 forms an image of the original document image read by the scanner 12. The printer unit 18 includes an intermediate transfer belt 21. The printer unit 18 supports the intermediate transfer belt 21 with a backup roller 40, a driven roller 41, and a tension roller 42. The backup roller 40 includes a driving portion (not illustrated). The printer unit 18 rotates the intermediate transfer belt 21 in a direction of an arrow m.

The printer unit 18 includes four sets of image forming stations 22Y, 22M, 22C and 22K. The image forming stations 22Y, 22M, 22C and 22K are used to respectively form yellow (Y), magenta (M), cyan (C) and black (K) images. The image forming stations 22Y, 22M, 22C and 22K are disposed in parallel in the rotation direction of the intermediate transfer belt 21 below the intermediate transfer belt 21.

The printer unit 18 includes cartridges 23Y, 23M, 23C and 23K over the image forming stations 22Y, 22M, 22C and 22K. The cartridges 23Y, 23M, 23C and 23K respectively store yellow (Y), magenta (M), cyan (C) and black (K) toner particles to be supplied.

Hereinafter, among the image forming stations 22Y, 22M, 22C and 22K, the yellow (Y) image forming station 22Y will be described later as an example. The image forming stations 22M, 22C and 22K have the same configurations as a configuration of the image forming station 22Y, and thus detailed description thereof will be omitted.

The image forming station 22Y includes an electrostatic charger 26, an exposure scanning head 27, a developing device 28, and a photoconductor cleaner 29. The electrostatic charger 26, the exposure scanning head 27, the developing device 28, and the photoconductor cleaner 29 are disposed around a photoconductive drum 24 which is rotated in an arrow n direction.

The image forming station 22Y includes a primary transfer roller 30. The primary transfer roller 30 opposes the photoconductive drum 24 with the intermediate transfer belt 21 interposed therebetween.

In the image forming station 22Y, the photoconductive drum 24 is charged by the electrostatic charger 26 and is then exposed to light by the exposure scanning head 27. The image forming station 22Y forms an electrostatic latent image on the photoconductive drum 24. The developing device 28 develops the electrostatic latent image on the photoconductive drum 24 by using a developer containing two components including toner and carriers.

The primary transfer roller 30 primarily transfers a toner image formed on the photoconductive drum 24 onto the intermediate transfer belt 21. The image forming stations 22Y, 22M, 22C and 22K form a color toner image on the intermediate transfer belt 21 by using the primary transfer roller 30. The color toner image is formed by sequentially overlapping yellow (Y), magenta (M), cyan (C) and black (K) toner images on each other. The photoconductor cleaner 29 removes toner remaining on the photoconductive drum 24 after the primary transfer.

The printer unit 18 includes a secondary transfer roller 32. The secondary transfer roller 32 opposes the backup roller 40 with the intermediate transfer belt 21 interposed therebetween. The secondary transfer roller 32 secondarily transfers the color toner image on the intermediate transfer belt 21 onto the sheet P. The sheet P is fed from the paper feeding cassette unit 16 or the manual paper feeding tray 17 along a transport path 33.

The printer unit 18 includes a belt cleaner 43 which opposes the driven roller 41 via the intermediate transfer belt 21. The belt cleaner 43 removes toner remaining on the intermediate transfer belt 21 after the secondary transfer. In addition, an image forming portion includes the intermediate transfer belt 21, the four sets of image forming stations (22Y, 22M, 22C and 22K), and the secondary transfer roller 32.

The printer unit 18 includes resist rollers 33*a*, a fixing device 34 (a fixing section), and paper discharge rollers 36 along the transport path 33. The printer unit 18 includes a branching portion 37 and a reverse transport portion 38 on the downstream side of the fixing device 34. The branching portion 37 forwards the sheet P after undergoing fixation to the paper discharge unit 20 or the reverse transport portion 38. In a case of duplex printing, the reverse transport portion 38 reverses and transports the sheet P which is sent from the branching portion 37, in the direction of the resist rollers 33*a*. The MFP 10 forms a fixed toner image on the sheet P in the printer unit 18. The MFP 10 discharges the sheet P on which the fixed toner image is formed to the paper discharge unit 20.

The MFP 10 is not limited to a tandem developing method. In the MFP 10, the number of developing device 28 is not limited thereto either. The MET 10 may direct transfer a toner image onto the sheet P from the photoconductive drum 24.

Hereinafter, the fixing device 34 will be described in detail.

Figure 2:
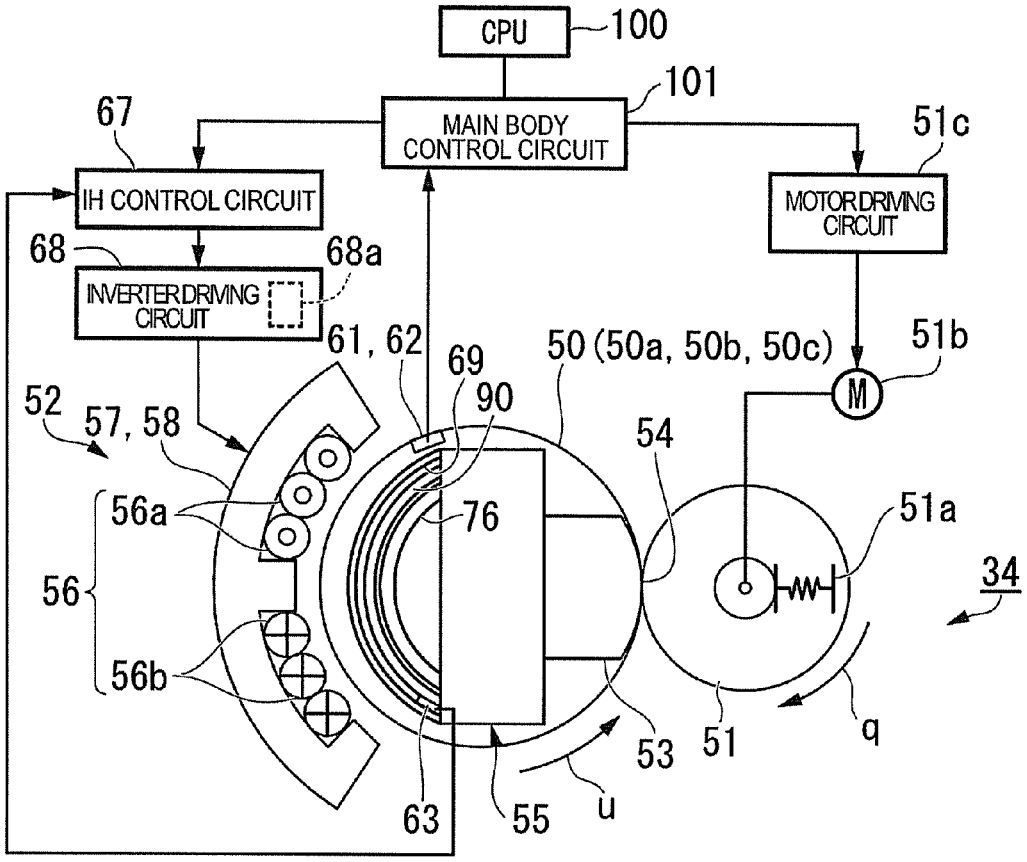
FIG. 2 is a side view of a fixing device including a control block of an IH coil unit.

FIG. 2 is a side view of the fixing device 34 including a control block of an electromagnetic induction heating coil unit 52 according to the first exemplary embodiment. The electromagnetic induction heating coil unit is referred to as an "IH coil unit".

As illustrated in FIG. 2, the fixing device 34 includes a fixing belt 50, a press roller 51, the IH coil unit 52, a first auxiliary heat generation plate 90, and a second auxiliary heat generation plate 69.

The fixing belt 50 is a tubular endless belt. An internal belt mechanism 55 which supports a nip pad 53 and the first auxiliary heat generation plate 90 and the second auxiliary heat generation plate 69 is disposed on an inner circumferential side of the fixing belt 50.

The fixing belt 50 is rotated in an arrow u direction by following a press roller 51. Alternatively, the fixing belt 50 may be rotated in the arrow u direction separately from the press roller 51. If the fixing belt 50 and the press roller 51 are rotated separately from each other, a one-way clutch may be provided so that a speed difference between the fixing belt 50 and the press roller 51 is not generated.

In the fixing belt 50, a heat generation layer 50*a* (conductive layer) which is a heat generation portion and a release layer 50*c* are sequentially laminated on a base layer 50*b*. In addition, a layer structure of the fixing belt 50 is not limited thereto as long as the fixing belt 50 includes the heat generation layer 50*a*.

For example, the base layer 50*b* is made of a polyimide resin (PI). For example, the heat generation layer 50*a* is made of a nonmagnetic metal such as copper (Cu). For example, the release layer 50*c* is made of a fluororesin such as a tetrafluoroethylene-perfluoroalkyl vinyl ether copolymer resin (PFA).

In the fixing belt 50, in order to realize rapid warming-up, the heat generation layer 50*a* is thinned so as to reduce the heat capacity. The fixing belt 50 having the small heat capacity reduces the time required in warming-up. Energy consumption is reduced by reducing the time required in the warming-up.

For example, in the fixing belt 50, a thickness of the copper layer of the heat generation layer 50*a* is 10 μm in order to reduce the heat capacity. For example, the heat generation layer 50*a* is covered by a protective layer such as nickel. The protective layer such as nickel prevents oxidation of the copper layer. The protective layer such as nickel improves mechanical strength of the copper layer.

The heat generation layer 50*a* may be formed on the base layer 50*b* made of a polyimide resin through electroless nickel plating and copper plating. Through the electroless nickel plating, adhesion strength between the base layer 50*b* and the heat generation layer 50*a* is improved. Through the electroless nickel plating, mechanical strength of the heat generation layer 50*a* is improved.

A surface of the base layer 50*b* may be roughened through sand blasting or chemical etching. Since the surface of the base layer 50*b* is roughened, adhesion strength between the base layer 50*b* and the plated nickel of the heat generation layer 50*a* is further mechanically improved.

A metal such as titanium (Ti) may be dispersed into the polyimide resin forming the base layer 50*b*. If a metal is dispersed into the base layer 50*b*, adhesion strength between the base layer 50*b* and the plated nickel of the heat generation layer 50*a* is further improved.

The heat generation layer 50*a* may be made of, for example, nickel, iron (Fe), stainless steel, aluminum (Al), and silver (Ag). The heat generation layer 50*a* may employ two or more kinds of alloys, and may employ two or more kinds of layered metals which overlap each other.

In the heat generation layer 50*a*, an eddy current is generated by magnetic flux which is generated by the IH coil unit 52. The heat generation layer 50*a* generate Joule heat by using the eddy current and electric resistance of the heat generation layer 50*a* so as to heat the fixing belt 50.

Figure 3:
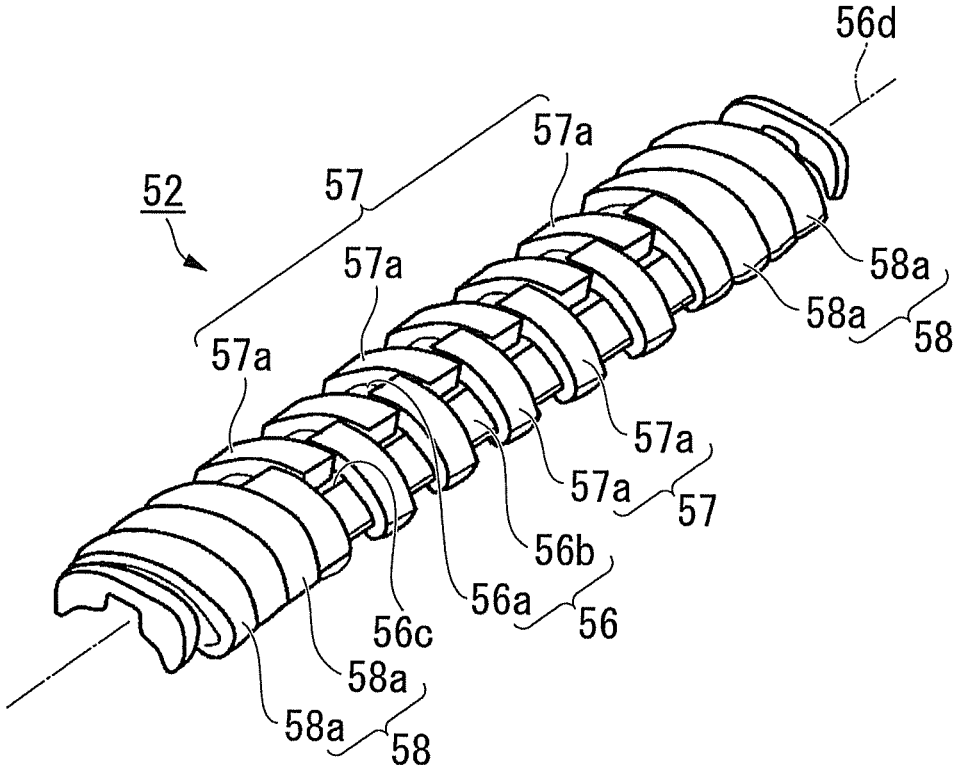
FIG. 3 is a perspective view of the IH coil unit.

FIG. 3 is a perspective view of the IH coil unit 52 according to the first exemplary embodiment.

As illustrated in FIG. 3, the IH coil unit 52 includes a coil 56, a first core 57, and second cores 58.

The coil 56 generates magnetic flux when a high frequency current is applied thereto. The coil 56 opposes the fixing belt 50 in a thickness direction. A longitudinal direction of the coil 56 matches a width direction (hereinafter, referred to as a "belt width direction") of the fixing belt 50.

The first core 57 and the second cores 58 cover an opposite side (hereinafter, referred to as a "rear surface side") of the coil 56 to the fixing belt 50. The first core 57 and the second cores 58 prevent the magnetic flux generated by the coil 56 from leaking out of the rear surface side. The first core 57 and the second cores 58 cause the magnetic flux from the coil 56 to concentrate on the fixing belt 50.

The first core 57 includes a plurality of one-wing portions 57*a*. The plurality of one-wing portions 57*a* are alternately disposed in a zigzag form so as to form axial symmetry with respect to a central line 56*d* lying in the longitudinal direction of the coil 56.

The second cores 58 are disposed on both sides of the first core 57 in the longitudinal direction. Each of the second cores 58 includes a plurality of two-wing portions 58*a* which extend over both wings of the coil 56.

For example, the one-wing portions 57*a* and the two-wing portions 58*a* are made of magnetic materials such as a nickel-zinc alloy (Ni—Zn) and a manganese-nickel alloy (Mn—Ni).

In the first core 57, the plurality of one-wing portions 57*a* restrict the magnetic flux generated by the coil 56. The magnetic flux generated by the coil 56 is alternately restricted every other one-wings of the coil 56 so as to form axial symmetry with respect to the central line 56*d*. In the first core 57, the plurality of one-wing portions 57*a* cause the magnetic flux from the coil 56 to concentrate on the fixing belt 50.

In the second cores 58, the plurality of two-wing portions 58*a* restrict the magnetic flux generated by the coil 56. The magnetic flux generated by the coil 56 is restricted by both of the wings of the coil 56 on both sides of the first core 57. In the second cores 58, the plurality of two-wing portions 58*a* cause the magnetic flux from the coil 56 to concentrate on the fixing belt 50. The magnetic flux concentration power of the second cores 58 is greater than the magnetic flux concentration power of the first core 57.

The coil 56 includes a first wing 56*a* and a second wing 56*b*. The first wing 56*a* is disposed on one side with respect to the central line 56*d*. The second wing 56*b* is disposed on the other side with respect to the central line 56*d*. A window portion 56*c* is formed between the first wing 56*a* and the second wing 56*b* and on an inner side of the coil 56 in the longitudinal direction.

As illustrated in FIG. 2, the IH coil unit 52 generates an inducted current while the fixing belt 50 is rotated in the arrow u direction. The heat generation layer 50*a* of the fixing belt 50 opposing the IH coil unit 52 generates heat due to the induced current.

For example, a litz wire is used as the coil 56. The litz wire is formed by bundling a plurality of copper wires coated with heat-resistive polyamide-imide which is an insulating material. The coil 56 is formed by winding a conductive coil.

The coil 56 generates magnetic flux when a high frequency current is applied thereto by an inverter driving circuit 68. For example, the inverter driving circuit 68 includes an insulated gate bipolar transistor (IGBT) element 68*a*.

Each of the first auxiliary heat generation plate 90 and the second auxiliary heat generation plate 69 is formed in an arc shape along the inner circumferential surface of the fixing belt 50. The first auxiliary heat generation plate 90 and the second auxiliary heat generation plate 69 oppose the first wing 56*a* and the second wing 56*b* of the coil 56 via the fixing belt 50. The first auxiliary heat generation plate 90 and the second auxiliary heat generation plate 69 cause an eddy current due to the magnetic flux generated by the IH coil unit 52 so as to generate heat. The first auxiliary heat generation plate 90 and the second auxiliary heat generation plate 69 assist the IH coil unit 52 with heat generation from the heat generation layer 50*a* of the fixing belt 50. The first auxiliary heat generation plate 90 and the second auxiliary heat generation plate 69 assist heating of the fixing belt 50.

The first auxiliary heat generation plate 90 and the second auxiliary heat generation plate 69 are disposed in a region surrounded by the fixing belt 50. The first auxiliary heat generation plate 90 is disposed further toward the inside of the fixing belt 50 in a diameter direction than the second auxiliary heat generation plate 69. The second auxiliary heat generation plate 69 is closer to the inner circumferential surface of the fixing belt 50 than the first auxiliary heat generation plate 90. The second auxiliary heat generation plate 69 is disposed to be separated from the inner circumferential surface of the fixing belt 50 with a gap therebetween. The second auxiliary heat generation plate 69 is disposed to be separated from the first auxiliary heat generation plate 90 with a gap therebetween.

Hereinafter, surfaces of the first auxiliary heat generation plate 90 and the second auxiliary heat generation plate 69 on the fixing belt 50 side are referred to as "diameter direction outer surfaces", and surfaces thereof on opposite sides to the fixing belt 50 are referred to as "diameter direction inner surfaces".

For example, a gap between the diameter direction outer surface of the second auxiliary heat generation plate 69 and the inner circumferential surface of the fixing belt 50 is about 1 mm to 2 mm. For, example, a gap between the diameter direction inner surface of the second auxiliary heat generation plate 69 and the diameter direction outer surface of the first auxiliary heat generation plate 90 is about 1 mm to 2 mm. For example, a gap between the diameter direction outer surface of the first auxiliary heat generation plate 90 and the inner circumferential surface of the fixing belt 50 is about 3 mm.

A thickness of the second auxiliary heat generation plate 69 is smaller than a thickness of the first auxiliary heat generation plate 90 in the belt width direction. For example, a thickness of the second auxiliary heat generation plate 69 is about 0.15 mm.

The first auxiliary heat generation plate 90 and the second auxiliary heat generation plate 69 are supported by a shield 76 on an opposite side to the coil 56. The shield 76 has the same arc shape as the first auxiliary heat generation plate 90 and the second auxiliary heat generation plate 69. The shield 76 is disposed on an inner circumferential side of the first auxiliary heat generation plate 90. For example, the shield 76 is made of a nonmagnetic material such as aluminum or copper. The shield 76 shields the magnetic flux from the IH coil unit 52. The shield 76 prevents the magnetic flux from influencing the nip pad 53 or the like.

The first auxiliary heat generation plate 90 does not generate heat by itself due to an induced current generated by the IH coil unit 52. For example, the first auxiliary heat generation plate 90 is formed of the following ferrite. The ferrite prompts promotes heat generation of the fixing belt 50 with magnetic flux caused by an induced current. The ferrite does not generate heat by itself even if receiving the magnetic flux caused by the induced current.

The first auxiliary heat generation plate 90 is made of, for example, a Mn—Zn based ferrite. The Mn—Zn based ferrite includes iron oxide ($Fe_2O_3$), zinc oxide (ZnO), and manganese oxide (MnO).

The second auxiliary heat generation plate 69 is made of a magnetic material. For example, the magnetic material is a magnetic shunt alloy. The magnetic shunt alloy which is an alloy of iron and nickel has a Curie point of 220° C. to 230° C. The magnetic shunt alloy is a thin metal member. If the Curie point is exceeded, the second auxiliary heat generation plate 69 has a weakened magnetic force, and thus heating assistance of the fixing belt 50 is weakened. Since the second auxiliary heat generation plate 69 is made of the magnetic shunt alloy, the fixing belt 50 is heated within a range of heat resistance temperatures. Magnetic characteristics of the magnetic shunt alloy change depending on a temperature. The magnetic shunt alloy transitions from a ferromagnet to a paramagnet with the Curie point as a boundary. The magnetic shunt alloy generates heat by itself. The magnetic shunt alloy has weakened magnetism with the Curie point as a boundary, and thus heating assistance of the fixing belt 50 is weakened.

The first auxiliary heat generation plate 90 and the second auxiliary heat generation plate 69 may be provided with a plurality of slits perpendicular to a direction of a current induced by the IH coil unit 52. If the first auxiliary heat generation plate 90 and the second auxiliary heat generation plate 69 are provided with the plurality of slits, an eddy current generated in the first auxiliary heat generation plate 90 and the second auxiliary heat generation plate 69 is divided thereby. In other words, the eddy current generated in the first auxiliary heat generation plate 90 and the second auxiliary heat generation plate 69 becomes an eddy occurring between the slits. Since the first auxiliary heat generation plate 90 and the second auxiliary heat generation plate 69 are provided with the plurality of slits, a size of an eddy occurring between the slits can be reduced more than if the first auxiliary heat generation plate 90 and the second auxiliary heat generation plate 69 are not provided with the plurality of slits. As a result of the size of the eddy occurring between the slits being reduced, heat generation of the first auxiliary heat generation plate 90 and the second auxiliary heat generation plate 69 can be reduced.

The first auxiliary heat generation plate 90 may be closer to the inner circumferential surface of the fixing belt 50 than to the second auxiliary heat generation plate 69. The first auxiliary heat generation plate 90 and the second auxiliary heat generation plate 69 may be in contact with the inner circumferential surface of the fixing belt 50.

Both ends with an arc shape of each of the first auxiliary heat generation plate 90 and the second auxiliary heat generation plate 69 are supported by the internal belt mechanism 55. For example, the internal belt mechanism 55 may cause the first auxiliary heat generation plate 90 and the second auxiliary heat generation plate 69 to approach and separate from the fixing belt 50. For example, the first auxiliary heat generation plate 90 and the second auxiliary heat generation plate 69 may separate from the fixing belt 50 before warming up the fixing device 34, and may approach the fixing belt 50 after warming up the fixing device 34.

Figure 4:
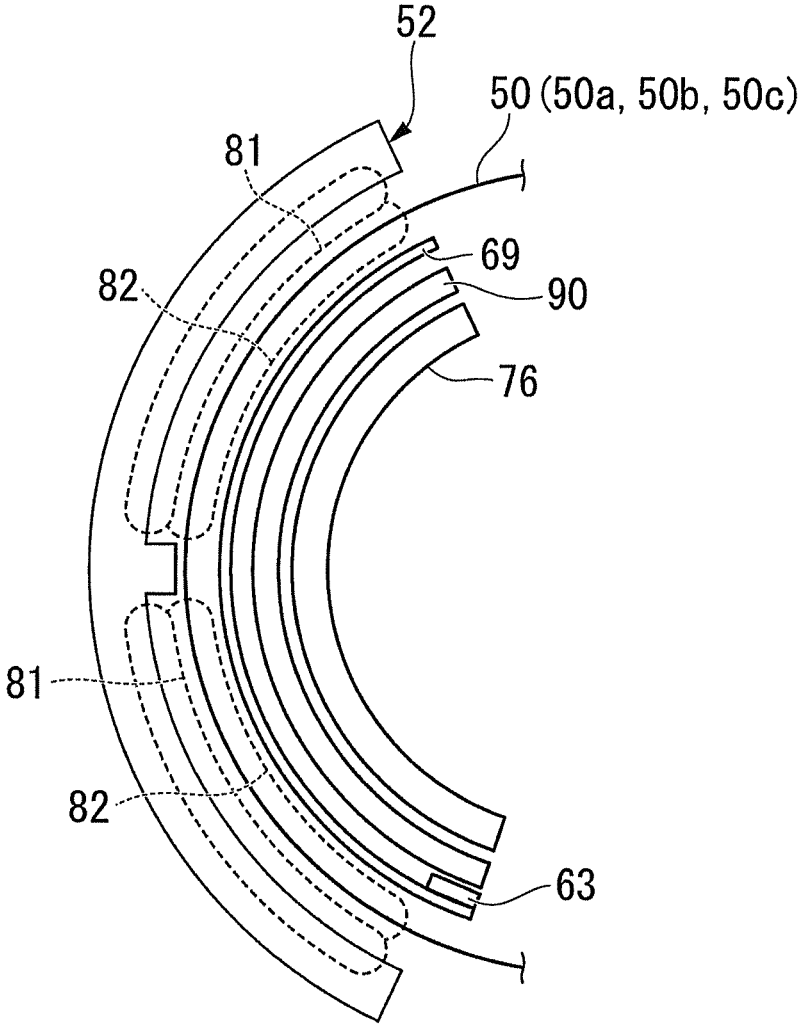
FIG. 4 is a diagram illustrating magnetic paths directed to a fixing belt and first and second auxiliary heat generation plates by magnetic flux from the IH coil unit.

FIG. 4 is a diagram illustrating magnetic paths directed to the fixing belt 50 and the first auxiliary heat generation plate 90 and the second auxiliary heat generation plate 69 by magnetic flux from the IH coil unit 52 according to the first exemplary embodiment. In FIG. 4, for convenience, the coil 56 and the like are not illustrated.

As illustrated in FIG. 4, magnetic flux generated by the IH coil unit 52 forms a first magnetic path 81 induced in the heat generation layer 50*a* of the fixing belt 50. The magnetic flux generated by the IH coil unit 52 forms a second magnetic path 82 induced in the first auxiliary heat generation plate 90 and the second auxiliary heat generation plate 69.

The first auxiliary heat generation plate 90 (ferrite) does not generate heat due to the magnetic flux generated by the IH coil unit 52. Here, generation of no heat includes a case where an amount of heat generated by the ferrite is very small and can thus be disregarded. For example, a temperature increase when the ferrite generated heat by itself was checked through the test, but the temperature was below 1° C. The second auxiliary heat generation plate 69 (the magnetic shunt alloy) generates heat due to the magnetic flux generated by the IH coil unit 52. The first auxiliary heat generation plate 90 and the second auxiliary heat generation plate 69 assist the heat generation layer 50*a* of the fixing belt 50 in generating heat as a result of the second magnetic path 82 being formed. The first auxiliary heat generation plate 90 and the second auxiliary heat generation plate 69 assist the heat generation layer 50*a* of the fixing belt 50 in generating heat during printing. A fixation temperature is maintained by assisting the heat generation layer 50*a* of the fixing belt 50 in generating heat.

As illustrated in FIG. 2, the nip pad 53 is a pressing portion which presses the inner circumferential surface of the fixing belt 50 toward the press roller 51 side. A nip 54 is formed between the fixing belt 50 and the press roller 51.

For example, the nip pad 53 is made of an elastic material such as silicon rubber or a fluororubber. The nip pad 53 may be made of a heat resistive resin such as a polyimide resin (PI), a polyphenylene sulfide resin (PPS), a polyether sulfone resin (PES), liquid crystal polymer (LCP), orphenol resin (PF).

For example, a sheet-like friction reducing member is disposed between the fixing belt 50 and the nip pad 53. The friction reducing member is formed of, for example, a sheet member or a release layer which is favorably slid and has good abrasion resistance. The friction reducing member is fixedly supported by the internal belt mechanism 55. The friction reducing member is slidably in contact with the inner circumferential surface of the traveling fixing belt 50. The friction reducing member may be formed of the following lubricious sheet member. The sheet member may be formed of a glass fiber sheet impregnated with a fluororesin.

The press roller 51 includes a heat resistive silicon sponge, a silicon rubber layer, or the like around its core. For example, a release layer is disposed on a surface of the press roller 51. The release layer is made of a fluororesin such as a PFA resin. The press roller 51 presses the fixing belt 50 with a pressing mechanism 51*a*. The press roller 51 is a pressing portion which presses the fixing belt 50 along with the nip pad 53. The press roller 51 is rotated in an arrow q direction by a motor 51*b*. The motor 51*b* is driven by a motor driving circuit 51*c* which is controlled by the main body control circuit 101.

A center thermistor 61, an edge thermistor 62, and a thermostat 63 are disposed in a region surrounded by the fixing belt 50.

The center thermistor 61 and the edge thermistor 62 detect a temperature of the fixing belt 50. The center thermistor 61 and the edge thermistor 62 output a detection result of the temperature of the fixing belt 50 to the main body control circuit 101. The center thermistor 61 is disposed at a center of the fixing belt 50 in the belt width direction.

The edge thermistor 62 is disposed further outward than the IH coil unit 52 in the belt width direction. The edge thermistor 62 detects a temperature of an outer part of the fixing belt 50 in the belt width direction with high accuracy without being influenced by the IH coil unit 52.

The main body control circuit 101 controls an IH control circuit 67 according to detection results from the center thermistor 61 and the edge thermistor 62. The IH control circuit 67 controls a high frequency current output from the inverter driving circuit 68 under the control of the main body control circuit 101. The fixing belt 50 is maintained in various control temperature ranges in accordance with an output from the inverter driving circuit 68.

The thermostat 63 functions as a safety device of the fixing device 34. The thermostat 63 operates if the fixing belt 50 or the second auxiliary heat generation plate 69 abnormally generates heat and thus a temperature thereof increases to a cut-off threshold value. If the thermostat 63 operates, a current does not flow to the IH coil unit 52. The MET 10 stops its operation if a current does not flow to the IH coil unit 52. The MFP 10 stops its operation and thus abnormal heat generation from the fixing device 34 is prevented.

Hereinafter, main portions of the fixing device 34 according to the first exemplary embodiment will be described with reference to FIG. 6.

Figure 6:
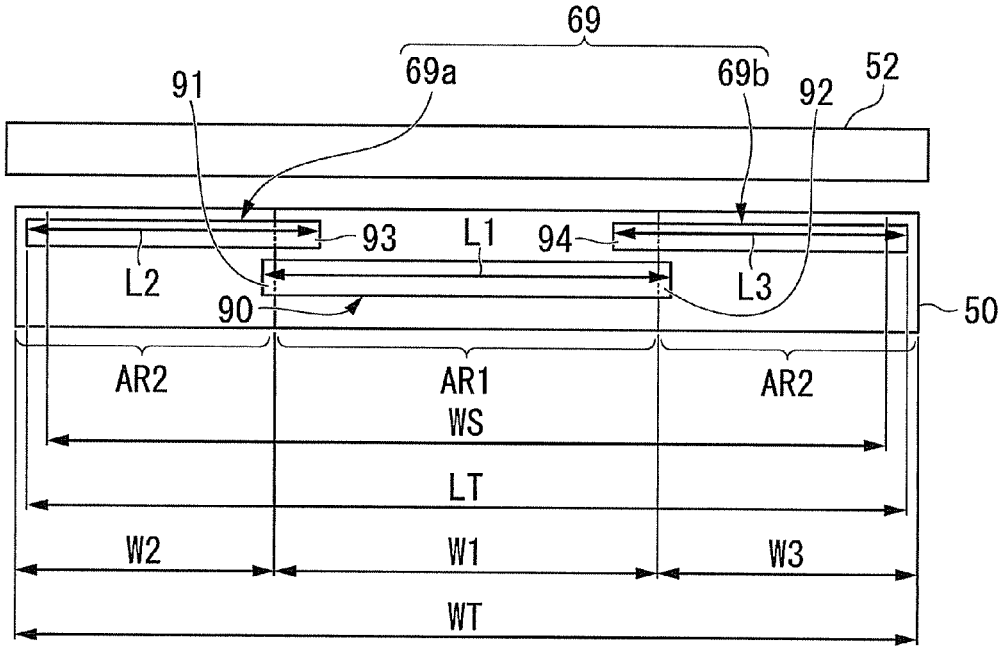
FIG. 6 is a diagram illustrating an arrangement of the first auxiliary heat generation plate, the second auxiliary heat generation plate, the fixing belt, and the IH coil unit.

FIG. 6 is a diagram illustrating an arrangement of the first auxiliary heat generation plate 90, the second auxiliary heat generation plate 69, the fixing belt 50, and the IH coil unit 52 according to the first exemplary embodiment.

As illustrated in FIG. 6, the first auxiliary heat generation plate 90 is located at the center of the fixing belt 50 in the belt width direction. The second auxiliary heat generation plate 69 includes a first division portion 69*a* and a second division portion 69*b*. The first division portion 69*a* is located at a first end of both ends of the fixing belt 50 in the belt width direction. The second division portion 69*b* is located at a second end of both ends of the fixing belt 50 in the belt width direction.

Hereinafter, a region AR1 through which the sheet P passes is referred to as a "sheet passing region", and a region AR2 through which the sheet P does not pass is referred to as a "sheet non-passing region". A length W1 of the sheet passing region AR1 in the belt width direction is referred to as a "sheet passing region width". In addition, a length W2 of the sheet non-passing region AR2 located at the first end in the belt width direction is referred to as a "first sheet non-passing region width". Further, a length W3 of the sheet non-passing region AR2 located at the second end in the belt width direction is referred to as a "second sheet non-passing region width". The greatest length WS of the sheet P in the belt width direction in the sheet P to be used is referred to as a "great sheet width".

For example, the sheet passing region width W1 is set to the same size as a short side width (hereinafter, referred to as an "A4R width") of A4 paper. For example, the sheet non-passing region AR2 is a region through which A4R does not pass. For example, the great sheet width WS is set to the same size as a short side width of A3 paper. A width WT (hereinafter, referred to as a "belt width") of the fixing belt 50 is a size obtained by adding the sheet passing region width W1, the first sheet non-passing region width W2, and the third sheet non-passing region width W3 together. The belt width WT is greater than the great sheet width WS.

The first auxiliary heat generation plate 90 opposes the sheet passing region AR1. The second auxiliary heat generation plate 69 opposes the sheet non-passing region AR2.

An end of the first auxiliary heat generation plate 90 on the sheet non-passing region AR2 side and an end of the second auxiliary heat generation plate 69 on the sheet passing region. AR1 side overlap each other when viewed from the thickness direction of the fixing belt 50. The end of the first auxiliary heat generation plate 90 on the sheet non-passing region AR2 side and ends of the first division portion 69*a* and the second division portion 69*b* on the sheet passing region AR1 side overlap each other when viewed from the thickness direction of the fixing belt 50.

Hereinafter, the entire length LT of the first auxiliary heat generation plate 90 and the second auxiliary heat generation plate 69 in the belt width direction is referred to as the "entire auxiliary heat generation plate width". A length L1 of the first auxiliary heat generation plate 90 in the belt width direction is referred to as a "first auxiliary heat generation plate width". A length L2 of the first division portion 69*a* in the belt width direction is referred to as a "first division portion width". A length L3 of the second division portion 69*b* in the belt width direction is referred to as a "second division portion width".

The entire auxiliary heat generation plate width LT is greater than the great sheet width S. The entire auxiliary heat generation plate width LT is smaller than the belt width WT.

The first auxiliary heat generation plate width L1 is greater than the sheet passing region width W1. For example, a ratio L1/W1 between the first auxiliary heat generation plate width L1 and the sheet passing region width W1 is about 1.0 to 1.2.

The first auxiliary heat generation plate 90 includes a first extending portion 91 and a second extending portion 92. The first extending portion 91 exceeds the sheet passing region AR1 and faces the first division portion 69*a*. The second extending portion 92 exceeds the sheet passing region AR1 and faces the second division portion 69*b*.

Hereinafter, a length of the first extending portion 91 in the belt width direction is referred to as a "first extending portion width". In addition, a length of the second extending portion 92 in the belt width direction is referred to as a "second extending portion width". The first extending portion width and the second extending portion width are the same as each other.

The first division portion width L2 is greater than the first sheet non-passing region width W2. For example, a ratio L2/W2 between the first division portion width L2 and the first sheet non-passing region width W2 is about 1.0 to 1.2.

The first division portion 69*a* separates from the first end of the fixing belt 50. The first division portion 69*a* includes an extension 93. The extension 93 exceeds the sheet non-passing region AR2 located at the first end and faces the first auxiliary heat generation plate 90.

The second division portion width L3 is greater than the second sheet non-passing region width W3. For example, a ratio L3/W3 between the second division portion width L3 and the second sheet non-passing region width W3 is about 1.0 to 1.2.

The second division portion 69*b* separates from the second end of the fixing belt 50. The second division portion 69*b* includes an extension 94. The extension 94 exceeds the sheet non-passing region AR2 located at the second end and faces the first auxiliary heat generation plate 90.

Hereinafter, a length of the extension 93 of the first division portion 69*a* in the belt width direction is referred to as an "extension width of the first division portion". In addition, a length of the extension 94 of the second division portion 69*b* in the belt width direction is referred to as an "extension width of the second division portion". The extension width of the first division portion 69*a* and the extension width of the second division portion 69*b* are the same as each other.

The extension width of the first division portion 69*a* is greater than the first extending portion width of the first auxiliary heat generation plate 90. The extension width of the second division portion 69*b* is greater than the second extending portion width of the first auxiliary heat generation plate 90.

The first auxiliary heat generation plate width L1 may be equal to or smaller than the sheet passing region width W1. The first extending portion width may be different from the second extending portion width. The first division portion width L2 may be smaller than the first sheet non-passing region width W2. The first division portion 69*a* may be in contact with the first end of the fixing belt 50. The second division portion width L3 may be smaller than the second sheet non-passing region width W3. The second division portion 69*b* may be in contact with the second end of the fixing belt 50. The extension width of the first division portion 69*a* may be different from the extension width of the second division portion 69*b*. The extension width of the first division portion 69*a* may be equal to or smaller than the first extending portion width of the first auxiliary heat generation plate 90. The extension width of the second division portion 69*b* may be equal to or smaller than the second extending portion width of the first auxiliary heat generation plate 90.

Hereinafter, a detailed description will be made of a control system 110 of the IH coil unit 52 which causes the fixing belt 50 to generate heat.

Figure 5:
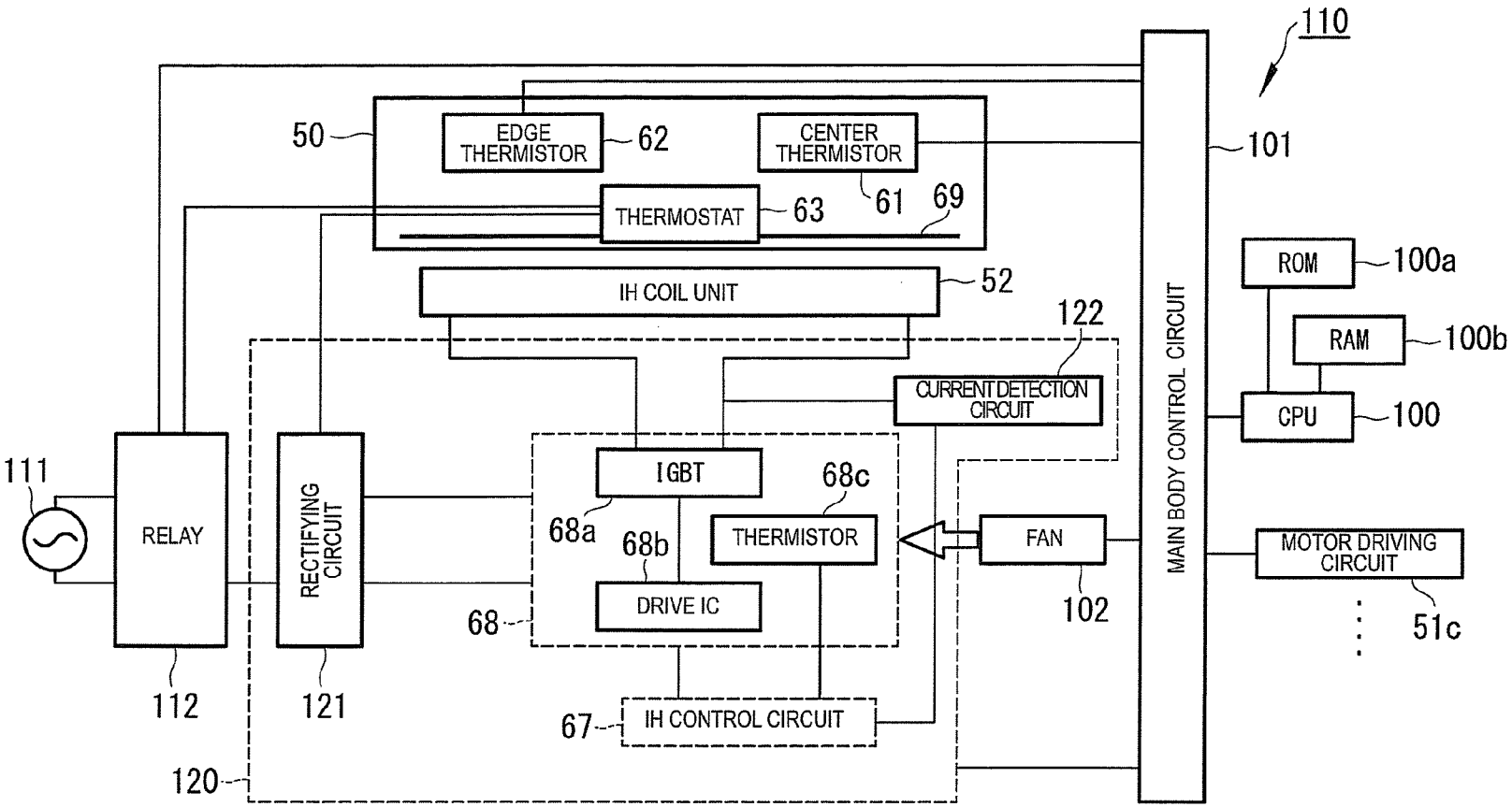
FIG. 5 is a block diagram illustrating a control system which mainly controls the IH coil unit.

FIG. 5 is a block diagram illustrating the control system 110 which mainly controls the IH coil unit 52 according to the exemplary embodiment.

As illustrated in FIG. 5, the control system 110 includes the CPU 100, a read only memory (ROM) 100*a*, a random access memory (RAM) 100*b*, the main body control circuit 101, an IH circuit 120, the motor driving circuit 51*c*.

In the control system 110, the IH circuit 120 supplies power to the IH coil unit 52. The IH circuit 120 includes a rectifying circuit 121, the IH control circuit 67, the inverter driving circuit 68, and a current detection circuit 122.

A current is input to the IH circuit 120 from an AC power source 111 via a relay 112. The IH circuit 120 rectifies the input current with the rectifying circuit 121 so as to supply the rectified current to the inverter driving circuit 68. The relay 112 cuts off a current from the AC power source 111 if the thermostat 63 is stopped. The inverter driving circuit 68 includes a drive IC 68*b* of the IGBT element 68*a*, and a thermistor 68*c*. The thermistor 68*c* detects a temperature of the IGBT element 68*a*. If the thermistor 68*c* detects an increase in the temperature of the IGBT element 68*a*, the main body control circuit 101 drives a fan 102 so as to cool the IGBT element 68*a*.

The IH control circuit 67 controls the drive IC 68*b* on the basis of detection results from the center thermistor 61 and the edge thermistor 62. The IH control circuit 67 controls the drive IC 68*b* so as to control an output of the IGBT element 68*a*. The current detection circuit 122 sends a detection result of the output of the IGBT element 68*a* to the IH control circuit 67. The IH control circuit 67 controls the drive IC 68*b* so that constant power is supplied to the coil 56 on the basis of the detection result from the current detection circuit 122.

Hereinafter, a description will be made of an operation of the fixing device 34 during warming-up.

As illustrated in FIG. 2, during warming-up, the fixing device 34 rotates the press roller 51 in the arrow q direction so that the fixing belt 50 is driven-rotated in the arrow u direction. The IH coil unit 52 generates magnetic flux on the fixing belt 50 side when the inverter driving circuit 68 applies a high frequency current thereto.

As illustrated in FIG. 4, the magnetic flux from the IH coil unit 52 induces the first magnetic path 81 which passes through the heat generation layer 50*a* of the fixing belt 50 so that the heat generation layer 50*a* generates heat. The magnetic flux from the IH coil unit 52, penetrating through the fixing belt 50 induces the second magnetic path 82 which passes through the first auxiliary heat generation plate 90 and the second auxiliary heat generation plate 69 so that the first auxiliary heat generation plate 90 and the second auxiliary heat generation plate 69 generate heat. The second magnetic path 82 formed between the heat generation layer 50*a* and the first auxiliary heat generation plate 90 and the second auxiliary heat generation plate 69 assist heating of the heat generation layer 50*a*.

As illustrated in FIG. 2, the IH control circuit 67 controls the inverter driving circuit 68 on the basis of a detection result from the center thermistor 61 or the edge thermistor 62. The inverter driving circuit 68 supplies a high frequency current to the coil 56.

Hereinafter, a description will be made of an operation of the fixing device 34 during a fixing operation.

If there is a printing request after the fixing belt 50 reaches a fixing temperature and finishes warming-up, the MFP 10 (refer to FIG. 1) starts a printing operation. The MFP 10 forms a toner image on the sheet P in the printer unit 18 and transports the sheet P to the fixing device 34.

In the MFP 10, the sheet P on which the toner image is formed passes the nip 54 between the fixing belt 50 reaching the fixing temperature and the press roller 51. The fixing device 34 fixes the toner image to the sheet P. During the fixing, the IH control circuit 67 controls the IH coil unit 52 so that the fixing belt 50 is kept at the fixing temperature.

Due to the fixing operation, the heat of the fixing belt 50 is taken by the sheet P. For example, if sheets continuously pass at a high speed, heat is excessively taken by the sheet P, and thus the fixing belt 50 with low heat capacity may not be kept at the fixing temperature. The heating of the fixing belt 50 is assisted by the second magnetic path 82 formed between the heat generation layer 50*a* and the first auxiliary heat generation plate 90 and the second auxiliary heat generation plate 69, and thus deficiency of a belt heat generation amount is supplemented. Since the fixing belt 50 is heated by the second magnetic path 82, a temperature of the fixing belt 50 is maintained to be the fixing temperature even if sheets continuously pass at a high speed.

Meanwhile, the heat capacity of the fixing belt 50 is small in order to reduce the warming-up time or the like. The fixing belt 50 obtains enough heat capacity for fixation of the sheet P with the assistance of heating caused by the first magnetic path 81 and the second magnetic path 82. A region through which the sheet P passes and a region through the sheet P does not pass are generated in the fixing belt 50 depending on a size of the sheet P. Hereinafter, a case where a sheet having the A4R width or having a width smaller than the A4R width is referred to as "during passing of a sheet with a small size". A case where A3 paper passes is referred to as "during passing of a sheet with a large size". If a fixing operation is continuously performed during passing of a sheet having a small size, a temperature decreases in the sheet passing region AR1 of the fixing belt 50, and a temperature increases in the sheet non-passing region AR2.

On the other hand, if paper continuously passes, a temperature of the magnetic shunt alloy is hard to control. Since a temperature of the magnetic shunt alloy is hard to control, a phenomenon in which the magnetic shunt alloy exceeds the Curie point frequently occurs, and thus an excessive amount of current flows through the IGBT element 68*a*. If the excessive amount of current flows through the IGBT element 68*a*, a temperature of the IGBT element 68*a* may be excessively increased, and thus the IGBT element 68*a* may be damaged.

For example, in order to prevent deterioration in heating assistance of the fixing belt 50 and damage of the IGBT element 68*a*, a magnetic body such as SUS430 may be provided in the sheet passing region AR1 in addition to the magnetic shunt alloy. However, if the magnetic body is provided, self-heat-generation of the magnetic body does not stop, and thus an internal temperature of the fixing belt 50 increases. If the internal temperature of the fixing belt 50 increases, the thermostat 63 may cause operation errors.

According to the first exemplary embodiment, the first auxiliary heat generation plate 90 opposes the sheet passing region AR1 in the belt width direction. The first auxiliary heat generation plate 90 contains ferrite. The ferrite does not generate heat by itself due to an induced current generated by the IH coil unit 52. Since the first auxiliary heat generation plate 90 contains the ferrite, the increase in the internal temperature of the fixing belt 50 is prevented when the magnetic body generating heat by itself is provided. Since the increase in the internal temperature of the fixing belt 50 is prevented, the thermostat 63 of the fixing device 34 which normally operates is prevented from causing operation errors. Since the first auxiliary heat generation plate 90 opposes the sheet passing region AR1, the IGBT element 68*a* can be prevented from being damaged when the magnetic shunt alloy opposes the sheet passing region AR1.

The second auxiliary heat generation plate 69 opposes the sheet non-passing region AR2 in the belt width direction. The second auxiliary heat generation plate 69 contains a magnetic shunt alloy as a magnetic material. The magnetic shunt alloy has weakened magnetism with the Curie point as a boundary, and thus heating assistance of the fixing belt 50 is weakened. Since the second auxiliary heat generation plate 69 contains the magnetic shunt alloy, a temperature of the sheet non-passing region AR2 of the fixing belt 50 is prevented from excessively increasing during passing of a sheet having a small size.

The first auxiliary heat generation plate 90 and the second auxiliary heat generation plate 69 are disposed in a region surrounded by the fixing belt 50. The first auxiliary heat generation plate 90 is disposed further toward the inside of the fixing belt 50 in the diameter direction than the second auxiliary heat generation plate 69. An increase in an internal temperature of the fixing belt 50 is prevented more than if the second auxiliary heat generation plate 69 is disposed further toward the inside of the fixing belt 50 in the diameter direction than the first auxiliary heat generation plate 90. Since an internal temperature of the fixing belt 50 is prevented from increasing, temperatures of components inside the fixing belt 50 are prevented from increasing. Since temperatures of the components inside the fixing belt 50 are prevented from increasing, the components inside the fixing belt 50 can be prevented from being damaged.

The end of the first auxiliary heat generation plate 90 on the sheet non-passing region AR2 side and the ends of the first division portion 69*a* and the second division portion 69*b* on the sheet passing region AR1 side overlap each other when viewed from the thickness direction of the fixing belt 50. Temperature unevenness is prevented from occurring in the fixing belt 50 between the sheet passing region AR1 and the sheet non-passing region AR2 when the end of the first auxiliary heat generation plate 90 on the sheet non-passing region AR2 side and the ends of the first division portion 69*a* and the second division portion 69*b* on the sheet passing region AR1 side separate from each other when viewed from the thickness direction of the fixing belt 50. Since temperature unevenness is prevented from occurring in the fixing belt 50 between the sheet passing region AR1 and the sheet non-passing region AR2, the fixing belt 50 can be made to uniformly generate heat.

The first auxiliary heat generation plate 90 is located at the center of the fixing belt 50 in the belt width direction. The second auxiliary heat generation plate 69 includes the first division portion 69*a* and the second division portion 69*b*. The first division portion 69*a* is located at the first end of both ends of the fixing belt 50 in the belt width direction. The second division portion 69*b* is located at the second end of both ends of the fixing belt 50 in the belt width direction. In a center-fixed fixation type belt, the fixing belt 50 can be made to uniformly generate heat.

The first auxiliary heat generation plate 90 and the second auxiliary heat generation plate 69 are disposed in a region surrounded by the fixing belt 50. The second auxiliary heat generation plate 69 is closer to the inner circumferential surface of the fixing belt 50 than the first auxiliary heat generation plate 90. The temperature responsiveness of the second auxiliary heat generation plate 69 improves more than if the first auxiliary heat generation plate 90 is closer to the inner circumferential surface of the fixing belt 50 than the second auxiliary heat generation plate 69.

Hereinafter, a fixing device according to a second exemplary embodiment will be described with reference to FIG. 7. The second exemplary embodiment employs a side-fixed fixation type and is thus different from the first exemplary embodiment which employs the center-fixed fixation type. In the second exemplary embodiment, the same constituent elements as the constituent elements described in the first exemplary embodiment are given the same reference numerals, and detailed description thereof will be omitted.

Figure 7:
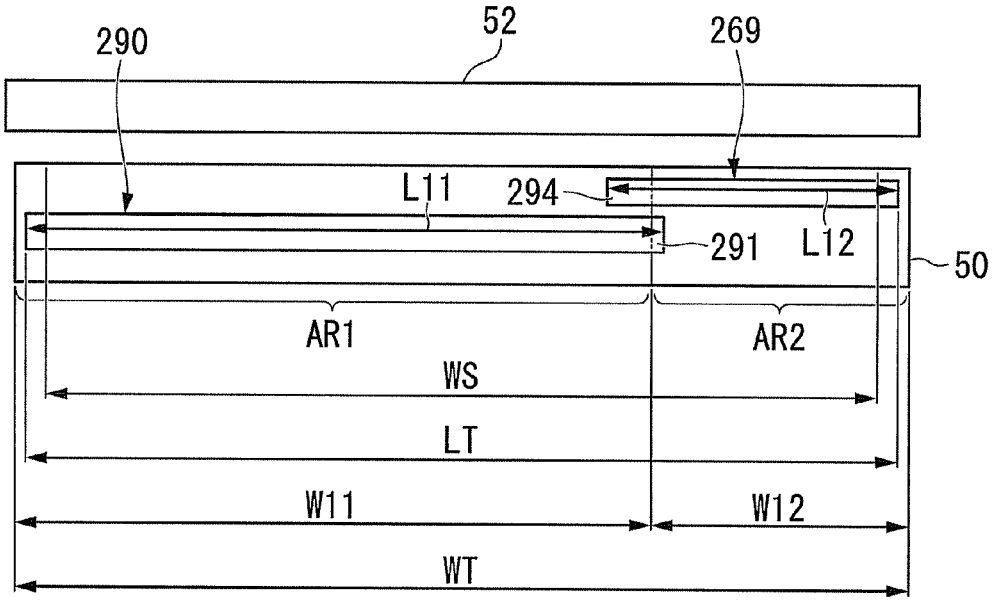
FIG. 7 is a diagram illustrating an arrangement of a first auxiliary heat generation plate, a second auxiliary heat generation plate, the fixing belt, and the IH coil unit according to a second exemplary embodiment.

FIG. 7 is a diagram illustrating an arrangement of a first auxiliary heat generation plate 290, a second auxiliary heat generation plate 269, the fixing belt 50, and the IH coil unit 52 according to the second exemplary embodiment.

As illustrated in FIG. 7, the first auxiliary heat generation plate 290 is located at a first end of both ends of the fixing belt 50 in the belt width direction. The second auxiliary heat generation plate 269 is located at a second end of both ends of the fixing belt 50 in the belt width direction.

Hereinafter, a length W11 of the sheet passing region AR1 in the belt width direction is referred to as a "sheet passing region width". In addition, a length W12 of the sheet non-passing region AR2 in the belt width direction is referred to as a "sheet non-passing region width".

For example, the sheet passing region width W11 is set to the same size as the A4R width. For example, the sheet non-passing region AR2 is a region through A4R does not pass. For example, the great sheet width WS is set to the same size as a short side width of A3 paper. The belt width WT is a size obtained by adding the sheet passing region width W11 and the first sheet non-passing region width W12 together.

The first auxiliary heat generation plate 290 opposes the sheet passing region AR1. The second auxiliary heat generation plate 269 opposes the sheet non-passing region AR2.

An end of the first auxiliary heat generation plate 290 on the sheet non-passing region AR2 side and an end of the second auxiliary heat generation plate 269 on the sheet passing region AR1 side overlap each other when viewed from the thickness direction of the fixing belt 50.

Hereinafter, a length L11 of the first auxiliary heat generation plate 290 in the belt width direction is referred to as a "first auxiliary heat generation plate width". A length L12 of the second auxiliary heat generation plate 269 in the belt width direction is referred to as a "second auxiliary heat generation plate width".

The first auxiliary heat generation plate width L11 is greater than the sheet passing region width W11. For example, a ratio L11/W11 between the first auxiliary heat generation plate width L11 and the sheet passing region width W11 is about 1.0 to 1.2.

The first auxiliary heat generation plate 290 separates from the first end of the fixing belt 50. The first auxiliary heat generation plate 290 includes an extending portion 291. The extending portion 291 exceeds the sheet passing region AR1 and faces the second auxiliary heat generation plate 269.

The second auxiliary heat generation plate width L12 is greater than the sheet non-passing region width W12. For example, a ratio L12/W12 between the second auxiliary heat generation plate width L12 and the sheet non-passing region width W12 is about 1.0 to 1.2.

The second auxiliary heat generation plate 269 separates from the second end of the fixing belt 50. The second auxiliary heat generation plate 269 includes an extending portion 294. The extending portion 294 exceeds the sheet non-passing region AR2 and faces the first auxiliary heat generation plate 90.

Hereinafter, a length of the extending portion 291 of the first auxiliary heat generation plate 290 in the belt width direction is referred to as an "extending portion width of the first auxiliary heat generation plate". A length of the extending portion 294 of the second auxiliary heat generation plate 269 in the belt width direction is referred to as an "extending portion width of the second auxiliary heat generation plate". The extending portion width of the second auxiliary heat generation plate 269 is greater than the extending portion width of the first auxiliary heat generation plate 290.

The first auxiliary heat generation plate width L11 may be equal to or smaller than the sheet passing region width W11. The first auxiliary heat generation plate 290 may be in contact with the first end of the fixing belt 50. The second auxiliary heat generation plate width L12 may be equal to or smaller than the sheet non-passing region width W12. The second auxiliary heat generation plate 269 may be in contact with the second end of the fixing belt 50. The extending portion width of the second auxiliary heat generation plate 269 may be equal to or smaller than the extending portion width of the first auxiliary heat generation plate 290.

According to the second exemplary embodiment, the first auxiliary heat generation plate 290 is located at the first end of both ends of the fixing belt 50 in the belt width direction. The second auxiliary heat generation plate 269 is located at the second end of both ends of the fixing belt 50 in the belt width direction. In the side-fixed fixation type, the fixing belt 50 can be made to uniformly generate heat.

According to at least one exemplary embodiment described above, the first auxiliary heat generation plate 90 opposes the sheet passing region AR1 in the belt width direction. The first auxiliary heat generation plate 90 contains the ferrite. The ferrite does not generate heat by itself due to an induced current generated by the IH coil unit 52. Since the first auxiliary heat generation plate 90 contains the ferrite, the increase in the internal temperature of the fixing belt 50 is prevented when the magnetic body generating heat by itself is provided. Since the increase in the internal temperature of the fixing belt 50 is prevented, the thermostat 63 of the fixing device 34 which normally operates is prevented from causing operation errors. Since the first auxiliary heat generation plate 90 opposes the sheet passing region AR1, the IGBT element 68*a* can be prevented from being damaged when the magnetic shunt alloy opposes the sheet passing region AR1.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A fixing device comprising:

a fixing belt that includes a conductive layer;

an induced current generation section that opposes the fixing belt in a thickness direction and performs electromagnetic induction heating on the conductive layer;

a first auxiliary heat generation section that opposes the induced current generation section with the fixing belt interposed therebetween, the first auxiliary heat generation section opposes a sheet passing region of the fixing belt in a width direction, and ferrite forms the first auxiliary heat generation section; and a second auxiliary heat generation section that opposes the induced current generation section with the fixing belt interposed therebetween, the second auxiliary heat generation section opposes a sheet non-passing region of the fixing belt in the width direction, and a magnetic shunt alloy forms the second auxiliary heat generation section.

2. The device according to claim 1, wherein an end of the first auxiliary heat generation section on the sheet non-passing region side and an end of the second auxiliary heat generation section on the sheet passing region side overlap each other when viewed from a thickness direction of the fixing belt.

3. The device according to claim 1, wherein the first auxiliary heat generation section is located at a center of the fixing belt in the width direction, and wherein the second auxiliary heat generation section includes a first division portion that is located at a first end of both ends of the fixing belt in the width direction, and a second division portion that is located at a second end of both the ends.

4. The device according to claim 3, wherein a length of the first auxiliary heat generation section in the width direction is greater than a length of the sheet passing region in the width direction.

5. The device according to claim 3, wherein a length of the first division portion in the width direction is greater than a length of the sheet non-passing region located at the first end in the width direction, and wherein a length of the second division portion in the width direction is greater than a length of the sheet non-passing region located at the second end in the width direction.

6. The device according to claim 1, wherein the first auxiliary heat generation section is located at a first end of both ends of the fixing belt in the width direction, and wherein the second auxiliary heat generation section is located at a second end of both the ends.

7. The device according to claim 6, wherein a length of the first auxiliary heat generation section in the width direction is greater than a length of the sheet passing region in the width direction.

8. The device according to claim 6, wherein a length of the second auxiliary heat generation section in the width direction is greater than a length of the sheet non-passing region in the width direction.

9. The device according to claim 1, wherein the first auxiliary heat generation section and the second auxiliary heat generation section are disposed in a region surrounded by the fixing belt, and wherein the second auxiliary heat generation section is closer to an inner circumferential surface of the fixing belt than the first auxiliary heat generation section.

10. A fixing device comprising:

a fixing belt that includes a conductive layer;

an induced current generation section that opposes the fixing belt in a thickness direction and performs electromagnetic induction heating on the conductive layer;

a first auxiliary heat generation section that opposes the induced current generation section with the fixing belt interposed therebetween, and a ferrite forms the first auxiliary heat generation section; and a second auxiliary heat generation section that opposes the induced current generation section with the fixing belt interposed therebetween, and a magnetic shunt alloy forms the second auxiliary heat generation section, wherein the first auxiliary heat generation section and the second auxiliary heat generation section are disposed in a region surrounded by the fixing belt, and wherein the first auxiliary heat generation section is located further toward an inside of the fixing belt in a diameter direction than the second auxiliary heat generation section.

11. The fixing device of claim 10, wherein the ferrite and the magnetic shunt alloy overlap each other when viewed from a thickness direction of the fixing belt.

12. The fixing device of claim 10, wherein the magnetic shunt alloy comprises a first division portion that is located at a first side of both ends of the fixing belt in the width direction, and a second division portion that is located at a second side of both the ends.

13. The fixing device of claim 12, wherein the ferrite is located at a center of the fixing belt in the width direction.

14. The fixing device of claim 13, wherein the magnetic shunt alloy is closer to an inner circumferential surface of the fixing belt than the ferrite.

* * * * *